United States Patent [19]

Trojan

[11] Patent Number: 5,029,543

[45] Date of Patent: Jul. 9, 1991

[54] ACCESSORY UNIT FOR A SEWING MACHINE FOR AUTOMATICALLY SEWING PIECES OF RIBBON MATERIAL ONTO A SEWING MATERIAL

[75] Inventor: Alfred Trojan, Greven, Fed. Rep. of Germany

[73] Assignee: Anton Cramer GmbH & Co., Fed. Rep. of Germany

[21] Appl. No.: 448,364

[22] Filed: Dec. 11, 1989

[30] Foreign Application Priority Data

Dec. 27, 1988 [DE] Fed. Rep. of Germany ..... 3844043

[51] Int. Cl.[5] ..... D05B 23/00; D05B 35/10; D05B 27/20

[52] U.S. Cl. ..... 112/152; 112/303; 112/321; 112/121.27

[58] Field of Search ..... 112/121.27, 152, 303, 112/321

[56] References Cited

U.S. PATENT DOCUMENTS

| | | | |
|---|---|---|---|
| 1,607,532 | 11/1926 | Halberg | 112/152 |
| 2,664,839 | 1/1954 | Cummins | 112/152 |
| 2,862,467 | 5/1954 | Passaro et al. | 112/121.27 |
| 4,076,273 | 1/1978 | Marforio | 112/152 |
| 4,813,361 | 3/1989 | Yunoki | 112/121.27 |

FOREIGN PATENT DOCUMENTS

| | | |
|---|---|---|
| 612228 | 7/1979 | Fed. Rep. of Germany . |
| 3534988 | 4/1987 | Fed. Rep. of Germany . |
| 3642863 | 6/1988 | Fed. Rep. of Germany . |
| 3702747 | 8/1988 | Fed. Rep. of Germany . |

*Primary Examiner*—Werner H. Schroeder
*Assistant Examiner*—Paul C. Lewis
*Attorney, Agent, or Firm*—Longacre & White

[57] ABSTRACT

An accessory unit (2) for a sewing machine (1) for automatically sewing pieces of ribbon material (20) onto a sewing material (5), has a hollow guide shaft (23) with a longitudinal slot (24) to guide the ribbon material (20). A needle (25) is used as an advance feed mechanism and can be inserted through the slot (24) into the ribbon material (20) which passes through the guide shaft (23), by means of which the ribbon material (20) can be advanced in the longitudinal direction of the guide shaft (23). The accessory unit (2) can be swivelled around a vertical axis (x) by at least 90° relative to the sewing machine (1).

15 Claims, 2 Drawing Sheets

Fig. 1
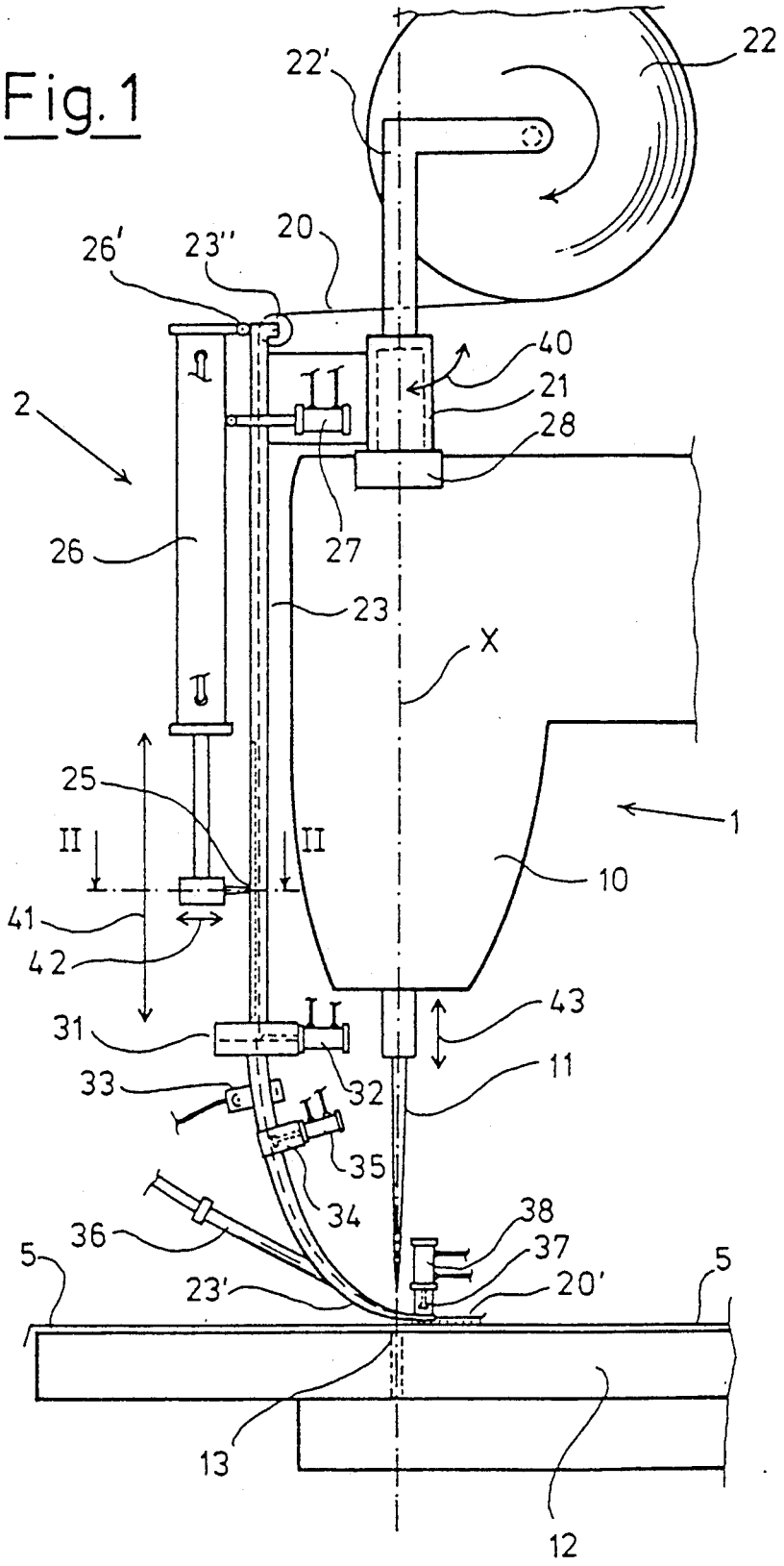
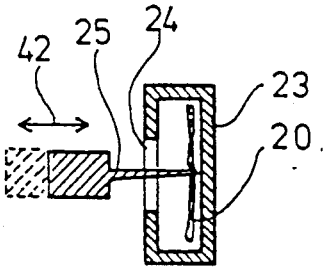
Fig. 2

ACCESSORY UNIT FOR A SEWING MACHINE FOR AUTOMATICALLY SEWING PIECES OF RIBBON MATERIAL ONTO A SEWING MATERIAL

BACKGROUND OF THE INVENTION

1. Field of the Invention

The invention relates to an accessory unit for a sewing machine which automatically sews pieces of ribbon material, in particular channelling strips, onto the sewing material in the correct position, wherein the sewing machine has a sewing head, a sewing needle which is guided therein and a presser foot, and wherein the accessory unit comprises a ribbon dispenser, a ribbon-guidance mechanism with a ribbon cutter along its length and a feed advance mechanism for the ribbon or severed pieces of ribbon.

2. Description of the Prior Art

An accessory unit of this type is known from DE-A-35 34 988. In this accessory unit the ribbon guidance mechanism and advance feed mechanism are formed jointly by an arrangement of a number of pairs of rollers of which at least one pair can be driven. The disadvantage of this accessory unit is that the ribbon guidance and advance feed mechanisms require on the one hand a relatively large amount of space for installation, and on the other are relatively complicated with respect to mechanical parts, whereby breakdowns can quite easily occur.

A further accessory unit for a sewing machine is known from DE-A-36 42 863.9 which is similarly designed for the application of ribbon materials. This accessory unit has a guide shaft with a small window on one side which can be slightly tilted around an axis horizontal to the sewing machine and which serves as a guidance mechanism. A motor-driven frictional wheel passes through this window into the inside of the shaft which either picks up the ribbon material and transports it further or is raised therefrom depending on the shaft's inclination. The unit displays a sewing or pressure foot independent of the guidance shaft which is a trough-shaped curved continuation of the shaft, with an intermediate space with no guidance, whose top surface is covered by an elastic tongue. The disadvantage of this accessory unit is that it too requires a large amount of installation space and is technically very complicated.

A further accessory unit of the type first mentioned is known from DE-A-37 02 747. In this accessory unit the ribbon conveyor is formed by a roller-driven continuous belt which essentially extends along a guide chute and the cutting device is arranged in the belt's direction of movement between the continuous belt and a second belt conveyor. The disadvantage of this accessory unit is that the belt conveyor requires a very high mechanical outlay and is subject to high wear and tear. Furthermore, during the operation of these types of belt conveyors there is slippage between the continuous belt and the ribbon to be conveyed which prevents an exact advance feed.

And finally, a further accessory unit for a sewing machine is known from DE-A-37 05 703 which is essentially formed by a vertically-moving shuttle with a ribbon take-up which is limited by gripping fingers. This accessory unit is designed especially for installation in the bed of a sewing machine or a work plate so as to feed a ribbon or section of ribbon to the underside of the sewing material. The installation of the accessory unit at the sewing head of a sewing machine is practically impossible since this unit has a very high horizontal working radius and requires a great deal of space for movement.

SUMMARY OF THE INVENTION

The object is thus to manufacture an accessory unit of the type first mentioned which requires a small installation space and reduced engineering whilst retaining reliable functions and which can be used for flexible and variable applications.

This object is solved according to the invention by an accessory unit of the type first mentioned, characterized in that the ribbon guidance system is formed by a guide shaft provided with a longitudinal slot on at least one side and along part of its length, and that the advance feed mechanism is designed as a needle or group of needles which are essentially arranged perpendicularly to the flat side of the ribbon which faces the longitudinal slot and which can be moved through the longitudinal slot by suitable actuating mechanisms both in the direction of their longitudinal axis as well as in the direction of the longitudinal slot.

The new accessory unit has the advantage that the mechanisms to guide and advance the ribbon can be installed compactly on the sewing machine. This is achieved in particular by the fact that no bulky rollers or roller drives are required. What is more, the new accessory unit allows a rhythmic advance feed of the ribbon by means of the needle(s) arrangement which is matched to the sewing machine's normal principle of operation, whereby the needles themselves only require a minimum of space and can be moved preferably by actuating mechanisms arranged parallel to the shaft, which also require little installation space. In order to transport the ribbon, the needle or group of needles are externally guided from their starting position through the longitudinal slot in the direction of their longitudinal axis and then pricked into the ribbon. By moving the needle or group of needles in the longitudinal direction of the slot the ribbon is pulled through the guide shaft in the same direction until a sufficient ribbon advance has been achieved. Once the needle or group of needles have been retracted from the ribbon and from the inside of the shaft in the direction of their longitudinal axis and have returned to their starting position, the next advance feed cycle can begin. In this way the ribbon advance feed can be carried out with absolutely no slippage, and thus very precisely. The length of the advance feed can hereby easily be adjusted by mechanically limiting the motion transfer of the needle or needle group's actuating mechanism and, e.g. by adjusting limit stops.

The direction or position of the ribbon material to be sewn on relative to the sewing material can also be easily altered by swivelling the accessory unit, which makes the unit very versatile and renders a turning of the sewing material unnecessary.

The accessory unit can also be used with no problems on automatic sewing machines on which two symmetrical sewing heads which can be moved in the same axial direction are used to work the two halves of the sewing material. Because the accessory unit requires only little space, the two sewing heads can still be moved very closely together without this leading to mutual obstructions by parts of the accessory unit since this has no overhanging or projecting parts.

In further embodiments of the invention it is planned that the lower part of the guide shaft will be curved and continued to the sewing needle's point of penetration and will be tangential to the top surface of the sewing material, whilst at the same time forming the pressure foot. This will contribute even further to the particularly simple construction and high operational safety of the accessory unit since the ribbon guidance system is designed in one piece and is continuous, in other words with no troublesome intermediate free space.

Additional advantageous developments and embodiments of the invention are described in the subclaims.

One embodiment of the invention will be described in the following with reference to the drawings.

BRIEF DESCRIPTION OF THE DRAWINGS

FIG. 1 a side view of an accessory unit for a sewing machine,

FIG. 2 a horizontal section of the accessory unit along the line II—II in FIG. 1, and FIG. 3 a top view of the accessory unit in FIG. 1.

DESCRIPTION OF THE PREFERRED EMBODIMENT

Figure 3:
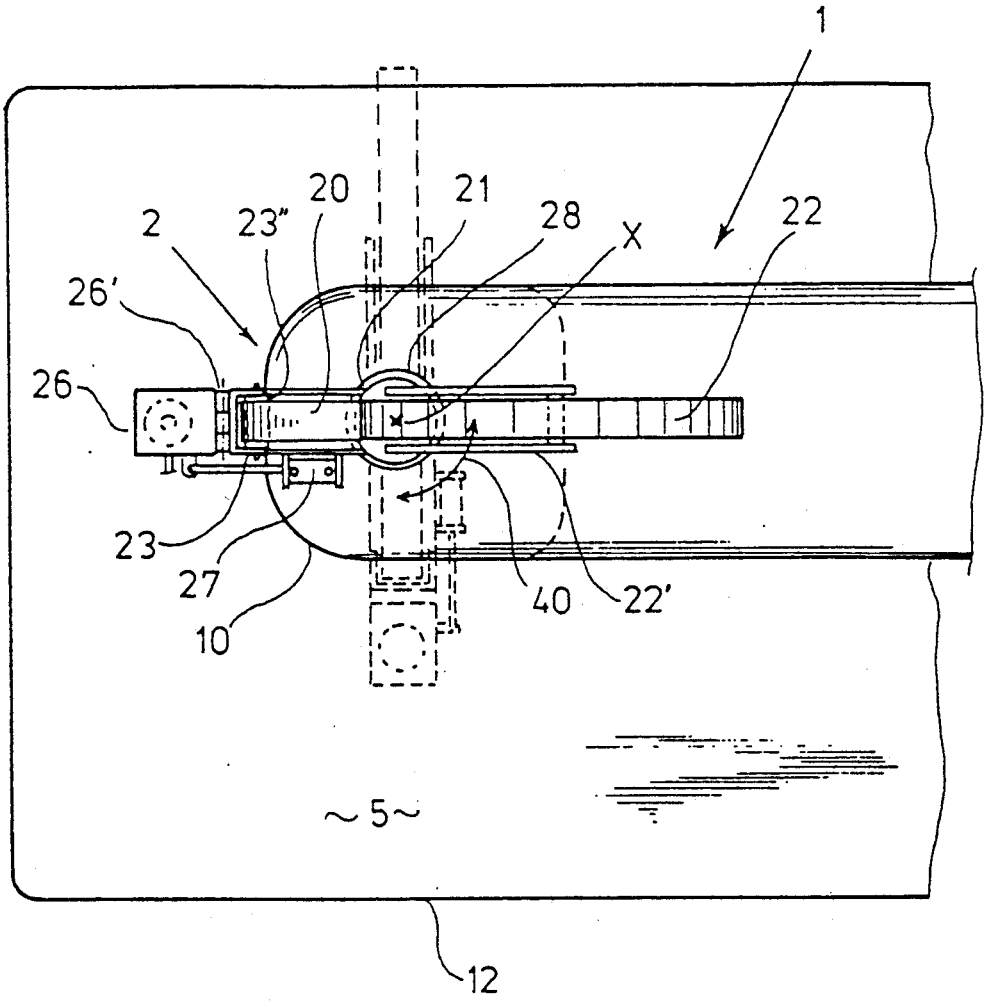

FIG. 1 of the drawings shows a side view of the sewing head 10 of a sewing machine 1 which is fitted with the accessory unit 2 according to the invention. Inside the sewing head 10 there is, as customary, a sewing needle 11 which projects downwards and which can be moved in a vertical direction, as shown by the arrow of motion 43. A work plate 12 can be seen below the sewing machine 1 which is only partly visible here, as is the sewing machine 1.

The whole of the accessory unit 2 is borne on a pivot bearing 21 on the top of the sewing head 10, and this can be swivelled around a vertical axis x by approx. 90° in the direction of the arrow of motion 40. The swivelling axis x is identical to the longitudinal axis of the sewing needle 11 and furthermore passes through the sewing needle's 11 point of penetration 13 through a sewing material 5 which lays on the work plate 12. A step motor drive unit 28 is provided between the sewing machine 1 and the pivot bearing 21 of the accessory unit 2 in order to produce the swivel movement in the direction of the arrow of motion 40.

The accessory unit furthermore comprises a guide shaft 23 which runs parallel to the x axis and which at the top is connected rigidly to the outer part of the pivot bearing 21. In its lower part 23' the guide shaft 23 curves towards the point of penetration 13, and reduces in thickness and leads tangentially to the top surface of the sewing material 5. At its top end the guide shaft 23 is fitted with a deflection and guide pulley 23'' via which a ribbon 20, e.g. a material ribbon, is guided into the inside of the guide shaft 23. The ribbon 20 is held in the form of a ribbon spool 22 on a revolving bobbin 22' above the pivot bearing 21.

A piston-cylinder unit 26 is provided parallel to the top part of the guide shaft 23 on the opposite side to the sewing head 10 and forms an articulated joint with the top end of the guide shaft 23 via a pendulum joint 26'. The piston rod of the piston-cylinder unit 26 projects below the casing and carries a protruding needle 25 at its tip on the side facing the guide shaft 23. By means of a further piston-cylinder unit 27, which is located in an almost horizontal position between the outer part of the pivot bearing 21 and the top part of the piston-cylinder unit 26, the latter can be swivelled in a vertical plane in the direction of the arrow of motion 42. Furthermore, the needle 25 can be moved vertically in the direction of the arrow of motion 41 by means of the piston-cylinder unit 26. In the needle's 25 field of motion the guide shaft 23 has a longitudinal slot 24 on the side facing the needle 25 which is shown by a dotted line and through which the needle 25 can be moved into the inside of the guide shaft 23.

A ribbon cutter 31 follows the longitudinal slot 24 in the further course of the guide shaft 23 which is of a known design and can be actuated by means of a further piston-cylinder unit 32. Following this, a scanning device 33 is provided on the curved part 23' of the guide shaft 23, which is here designed as a photoelectric barrier, which illuminates the inside of the guide shaft 23 transverse to the direction of the ribbon's 20 movement. There then follows in the further course of the guide shaft 23, or rather its curved part 23', a brake device 34, which can similarly be actuated by means of a piston-cylinder unit 35 and which when actuated takes hold of or clamps a piece of ribbon 20' which has already been cut in its rear part and thus fixes it in this position. Finally, at the tip of the curved part 23' of the guide shaft 23 there is a pressure pad 37 which is actuated by a further piston-cylinder unit 38. This pressure pad serves to press the front end of a piece of ribbon 20' onto the sewing material 5 until the first stitches have been carried out by the sewing machine 1.

Finally, between the brake device 34 and the pressure pad 37 there is a blower airline 36 with tangential discharge which points in the direction of the free end of the curved part 23' of the guide shaft 23. This blower airline 36 serves to further transport a severed piece of ribbon 20' within the curved part 23' of the guide shaft 23.

The construction of the guide shaft 23 as well as the interaction with the needle 25 becomes particularly clear in the cross-section in FIG. 2 along the axis II—II of FIG. 1. The guide shaft 23 has a fundamentally rectangular cross-section with a hollow interior. On one of its flat sides the guide shaft 23 has the afore-mentioned longitudinal slot 24. The ribbon 20 is fed through the guide shaft 23, the thickest and widest ribbon to be worked being slightly thinner and narrower than the dimensions of the hollow interior of the guide shaft 23.

The needle 25 can be moved in the inside of the guide shaft 23 through the longitudinal slot 24, as shown by the arrow of motion 42. When inserted, the needle 25 penetrates the ribbon 20 passing through the inside of the guide shaft 23, as a result of which the ribbon is transported through the guide shaft 23 by a corresponding movement of the needle 25 in the longitudinal direction of the longitudinal slot 24.

FIG. 3 of the drawings clearly shows the space-saving arrangement of the accessory unit 2 for the sewing machine 1. To the right in FIG. 3 is shown a part of the sewing machine 1 with the sewing head 10 below, wherein the sewing machine 1 with its sewing head 10 is above a work plate 12 which supports a sewing material 5.

The accessory unit 2 can be swivelled around the axis x, which here is vertical to the plane of the drawing, by at least 90° in the direction of the arrow of motion 40. In order to allow this swivel movement there is a pivot bearing 21 on the top of the sewing head 10 which in combination with the step motor drive unit 28 guarantees a defined angle position of the accessory unit 2. To the right of the accessory unit 2 is shown the ribbon reserve in the form of a ribbon spool 22 which is borne on a revolving bobbin 22'.

To the left of the accessory unit 2 is shown the guide shaft 23 viewed from the top, with the deflection pulley 23'' to support the infeed of the ribbon 20 unwound from the ribbon spool 22 which is positioned here. On the side of the guide shaft 23 which is opposite the sewing head 10 we can see the piston-cylinder unit 26 for the advance feed of the ribbon 20. The top of the piston-cylinder unit 26 is fixed by the revolving pendulum joint 26 to the top end of the guide shaft 23, which in turn is rigidly fixed to the outer part of the pivot joint 21 which bears the accessory unit 2.

In addition seen to the side of, i.e. in FIG. 3 below, the shaft 23 is the piston-cylinder unit 27 which produces the pendulum movement of the piston-cylinder unit 26.

And finally in FIG. 3, the accessory unit 2 is shown by dotted lines in a rotated position 90° anticlockwise whereby it becomes very clear that the accessory unit is extremely versatile and that in particular it is possible to sew ribbons onto a sewing material 5 in various directions without the sewing material 5 having to be turned or twisted. Furthermore, the compact, space-saving construction of the accessory unit 2 permits its installation on the sewing heads 10 of automatic sewing machines which are designed axially symmetric and whose two sewing heads are movable on one common axis. On account of the accessory unit's 2 slight projections the sewing heads 10 can still be moved very close towards each other without this leading to mutual obstructions. The rotation of both accessory units on the pair of sewing heads is then preferably carried out in opposite directions.

In the following the function of the accessory unit 2 will be explained briefly on the basis of an example of the process:

The ribbon 20 is fed into the inside of the guide shaft 23 from the ribbon spool 22 via the deflection pulley 23''. Inside the guide shaft 23 the ribbon 20 is rhythmically pushed and pulled downwards in a vertical direction by the corresponding actuation of the piston-cylinder units 26 and 27. As soon as a sufficient ribbon advance feed has been carried out a piece of ribbon 20' is cut off by the ribbon severer 31. This is then transported further within the curved part 23' of the guide shaft 23 by means of air blown through the blower airline 36 until the photoelectric barrier 33 recognizes the end of the piece of ribbon 20'. At this point in time the piston-cylinder unit 35 is actuated which for its part actuates the brake device 34 and holds the piece of ribbon 20' in this position. The front end of the piece of ribbon 20' is exactly below the pressure pad 37, which is similarly actuated after the brake device 34. The front end of the piece of ribbon 20' is thus pressed against the sewing material 5 and can be sewn onto this after the brake device 34 has been released and the sewing machine 1 started. After the first stitches have been made the pressure pad 37 is also returned to its initial position. Following an automatic or manual movement of the sewing material 5 or the sewing machine 1, the procedure explained here is repeated until the sewing material 5 is trimmed with the preset number of pieces of ribbon 20'. The pieces of ribbon 20' can be sewn onto the sewing material 5 in random directions since the accessory unit 2 can be rotated by at least 90° around the axis x and intermediate angles between 0° and 90° can be set at random by means of the step motor drive unit 28.

The actuation of the sewing machine 1 and the accessory unit 2, to be more precise the piston-cylinder units 26, 27, 32, 35 and 38 which ae present on the accessory unit, as well as the registration of information from the scanning unit 33 is preferably carried out by means of an electronic control unit, such as are already in widespread use for the control of sewing machines and automatic sewing machines, and which can be expanded to control and monitor the accessory unit 2 with corresponding auxiliary programs.

What is claimed is:

1. An accessory unit for a sewing machine for automatically sewing pieces of a ribbon material onto a sewing material in a correct position, the sewing machine having a sewing head, a sewing needle having a longitudinal axis and which is guided in the sewing head and a pressure foot, the accessory unit comprising a ribbon dispenser, a ribbon-guidance mechanism, a ribbon cutter for severing the ribbon material and an advance feed mechanism for the ribbon material and for pieces of the ribbon material severed by the ribbon cutter, wherein the ribbon-guidance mechanism is formed by a guide shaft provided with a longitudinal slot on at least one side thereof and along part of the length thereof, and wherein the advance feed mechanism is formed by at least one needle arranged substantially perpendicularly to a flat side of the ribbon material which faces the longitudinal slot, said at least one needle having a longitudinal axis and being moveable by an actuating mechanism through the longitudinal slot in both the direction of at least one longitudinal axis said at least one needle and in the longitudinal direction of the slot.

2. An accessory unit in accordance with claim 1, wherein the whole of the unit is rotatable by at least 90° about an axis which passes through a point of penetration of the sewing needle through the sewing material and which is substantially identical with the longitudinal axis of the sewing needle.

3. An accessory unit in accordance with claim 1, wherein a lower part of the guide shaft is curved and extends to a point of penetration of the sewing needle through the sewing material and an end portion of the lower part of the guide shaft is tangential to a top surface of the sewing material and forms the pressure foot.

4. An accessory unit in accordance with claim 1, wherein a brake device is provided below the ribbon cutter in a direction of movement of the ribbon material, the brake device registering and clamping an end part of a severed piece of ribbon and being actuatable by remote-control depending on an advance feed position of the severed piece of ribbon material.

5. An accessory unit in accordance with claim 1, wherein a scanning device is provided on the guide shaft for determining a position of a severed piece of ribbon material.

6. An accessory unit in accordance with claim 5, wherein the scanning device comprises at least one photoelectric barrier which transversely illuminates an inside of the guide shaft.

7. An accessory unit in accordance with claim 1, wherein a remote-controllable pressure pad is provided adjacent a free end of the guide shaft proximal to the sewing needle, for pressing an end of a severed piece of ribbon material onto the sewing material as the end is sewn thereon by the sewing machine.

8. An accessory unit in accordance with claim 3, wherein the curved lower part of the guide shaft has located therein a tangentially directed blower airline which discharges air in a direction of the end portion of the lower part of the guide shaft, for transporting a severed piece of ribbon material within the curved part of the guide shaft.

9. An accessory unit in accordance with claim 7, wherein the actuating mechanism for said at least one needle, the ribbon cutter and the pressure pad each comprises a pneumatically operated piston cylinder unit.

10. An accessory unit in accordance with claim 4, wherein the brake device comprises a pneumatically operated piston cylinder unit.

11. An accessory unit in accordance with claim 2, wherein the unit is rotatable by means of a pneumatically driven piston cylinder unit working on a pivoted lever.

12. An accessory unit in accordance with claim 2, wherein the unit is rotatable in defined angle steps by means of an electrically or pneumatically driven step motor drive unit.

13. An accessory unit in accordance with claim 1, wherein the unit is one of an axially symmetric pair of accessory units installed on two axially symmetrically arranged sewing heads of a twin-head sewing machine.

14. An accessory unit in accordance with claim 2, wherein the unit is one of an axially symmetric pair of accessory units installed on two axially symmetrically arranged sewing heads of a twin-head sewing machine and wherein the two accessory units of the pair are rotatable in opposite directions.

15. An accessory unit in accordance with claim 5, further comprising an electronic control unit for monitoring and controlling the actuating mechanism for the needle or needles in accordance with a program stored therein and information supplied by the scanning device.

* * * * *